US007455367B2

(12) United States Patent
Kellermann et al.

(10) Patent No.: US 7,455,367 B2
(45) Date of Patent: Nov. 25, 2008

(54) LONGWALL SUPPORT CONTROL FOR CONTROLLING THE MOVEMENTS OF LONGWALL SUPPORT UNITS IN THE LONGWALL OF A MINE

(75) Inventors: Ursula Kellermann, Erlangen (DE); Christian Kellermann, Erlangen (DE); Holger Kellermann, Erlangen (DE)

(73) Assignee: Tiefenbach Control Systems GmbH, Essen (DE)

( * ) Notice: Subject to any disclaimer, the term of this patent is extended or adjusted under 35 U.S.C. 154(b) by 0 days.

(21) Appl. No.: 10/538,389

(22) PCT Filed: Dec. 11, 2003

(86) PCT No.: PCT/DE03/04082

§ 371 (c)(1),
(2), (4) Date: Mar. 3, 2006

(87) PCT Pub. No.: WO2004/055330

PCT Pub. Date: Jul. 1, 2004

(65) Prior Publication Data

US 2006/0220438 A1 Oct. 5, 2006

(30) Foreign Application Priority Data

Dec. 16, 2002 (DE) ..... 102 59 010

(51) Int. Cl.

| | |
|---|---|
| ***E21D 23/12*** | (2006.01) |
| ***E21D 23/14*** | (2006.01) |
| ***E21D 23/00*** | (2006.01) |
| ***E21C 35/24*** | (2006.01) |

(52) U.S. Cl. ..... 299/1.7; 405/302

(58) Field of Classification Search ..... 299/1.05, 299/1.3, 1.6, 1.7; 405/302

See application file for complete search history.

(56) References Cited

U.S. PATENT DOCUMENTS

| | | | | |
|---|---|---|---|---|
| 3,406,342 | A * | 10/1968 | Hubner | 340/503 |
| 4,146,271 | A * | 3/1979 | Ward et al. | 299/1.7 |
| 5,029,943 | A * | 7/1991 | Merriman | 299/1.7 |
| 5,062,033 | A | 10/1991 | Kussel et al. | |
| 6,481,802 | B1 * | 11/2002 | Kussel | 299/1.6 |
| 6,509,842 | B1 * | 1/2003 | Kussel | 340/870.28 |

FOREIGN PATENT DOCUMENTS

DE 195 46 427 A1 8/1996

(Continued)

*Primary Examiner*—Sunil Singh
(74) *Attorney, Agent, or Firm*—Alston & Bird LLP

(57) ABSTRACT

A longwall support control for controlling the movements of longwall support units in the longwall of a mine that includes a central control system and a plurality of control units, of which a separate control unit (mining shield control device) is locally and operationally associated to each longwall support unit. The mining shield control devices connect to the central control system and to one another via two bus lines, through which each of the mining shield control devices can be called up for inputting a control command from the central control system or an adjacent mining shield control device. The identical second bus line (parallel bus) permits retransmitting to the adjacent mining shield control device, incoming signals that do not store a code word assigned to the respectively addressed mining shield control device.

4 Claims, 3 Drawing Sheets

FOREIGN PATENT DOCUMENTS

| | | | | |
|---|---|---|---|---|
| DE | 197 47 054 | C1 | | 1/1999 |
| DE | 10207698 | | * | 2/2002 |
| DE | 10207698 | A1 | * | 10/2002 |
| DE | 199 82 113 | C1 | | 12/2003 |
| GB | 2167924 | | * | 6/1986 |
| GB | 2265652 | A | * | 10/1993 |

* cited by examiner

LONGWALL SUPPORT CONTROL FOR CONTROLLING THE MOVEMENTS OF LONGWALL SUPPORT UNITS IN THE LONGWALL OF A MINE

BACKGROUND

The invention relates to a longwall support control for controlling the movements of longwall support units in the longwall of a mine.

A control system of this type is disclosed, for example, in DE 102 07 698.7 A1 as well as in DE 199 82 113.5-24 A1 (U.S. Pat. No. 6,481,802).

This longwall support control permits activating the individual longwall support control units, in the present application also referred to as mining shields, from a central control or by individual control units, which are each associated to a mining shield (mining shield control devices). In this connection, it is possible to activate from one of the mining shield control devices respectively the adjacent or a plurality of adjacent mining shields. Basically, the control signals are supplied to all mining shield control devices via a common line. However, the mining shield control devices are programmed such that only that mining shield control device is addressed and caused to execute the switching commands, to which the code word is associated that is transmitted along with the control command. All other mining shield control devices retransmit the control signal with the code word.

With an input of a control command, the common line (bus line) is taken.

It is an object of the invention to improve a longwall support control, which permits transmitting along with a control signal also other signals at the same time.

BRIEF SUMMARY OF THE PRESENT INVENTION

The present invention achieves the above and other objects by providing a longwall support control for controlling the movements of longwall support units in the longwall of a mine, comprising a central control system; and a plurality of control units, of which a separate mining shield control device is locally and operationally associated to each longwall support unit, the mining shield control devices connecting to the central control system and to one another by means of at least one bus line, through which each of the mining shield control devices can be called up from the central control system or an adjacent mining shield control device for inputting a control command, and with each mining shield control device being programmed such that it is possible to deliver for execution to the mining shield control device, control commands that are received via the bus line, and which each store a code word associated with the respectively called up mining shield control device, wherein the mining shield control devices connect via a parallel bus line to the central control system and to one another, and the mining shield control devices are programmed such that signals that are received via one of the bus lines, and which do not store a code word associated with the respectively called up mining shield control device, are retransmitted to the adjacent mining shield control device.

Because of the length of the longwall, there is a risk that the signals from mining shield control device to mining shield control device are so greatly attenuated that they can no longer be received by far removed mining shield control devices, in particular by the central control system.

This problem is avoided for both bus lines and all transmitted signals respectively by including in the mining shield control device, an amplifier for the signals that do not store a code word assigned to the respectively called up mining shield control device, and which come in via at least one of the two bus lines.

Irrespective of the input of control signals, the invention makes it also possible to transmit measuring signals or other signals of state to the operator or the central control system. Likewise, in the case of each control signal, it is also possible to release at the same time and without a time delay an acknowledgment signal, which acknowledges the receipt and/or the execution of the control command.

BRIEF DESCRIPTION OF THE DRAWINGS

Reference will now be made to the accompanying drawings, wherein.

DETAILED DESCRIPTION OF THE INVENTION

Figure 1:
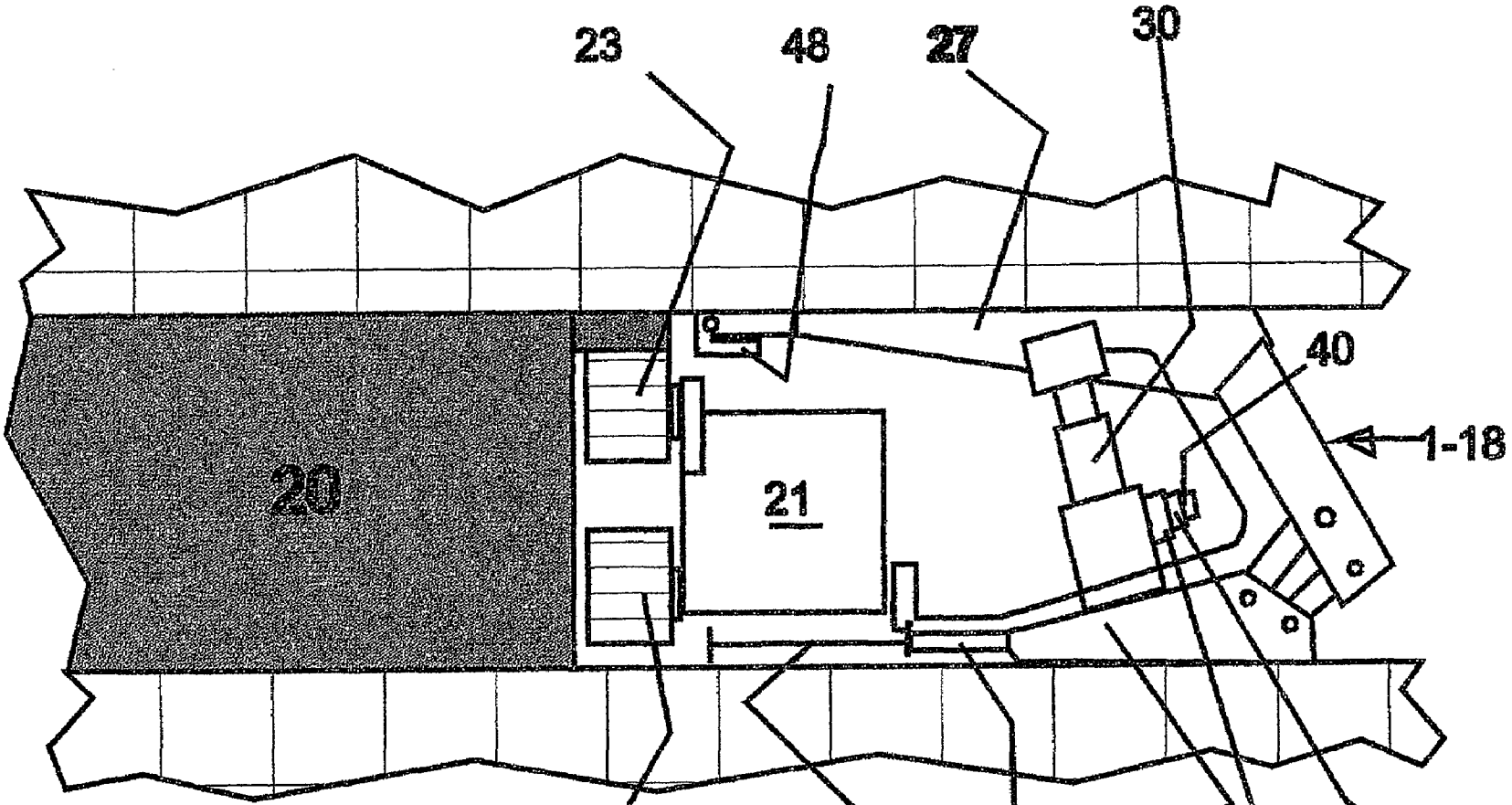
FIG. 1 is a sectional view of a longwall face with a longwall support.
Figure 2:
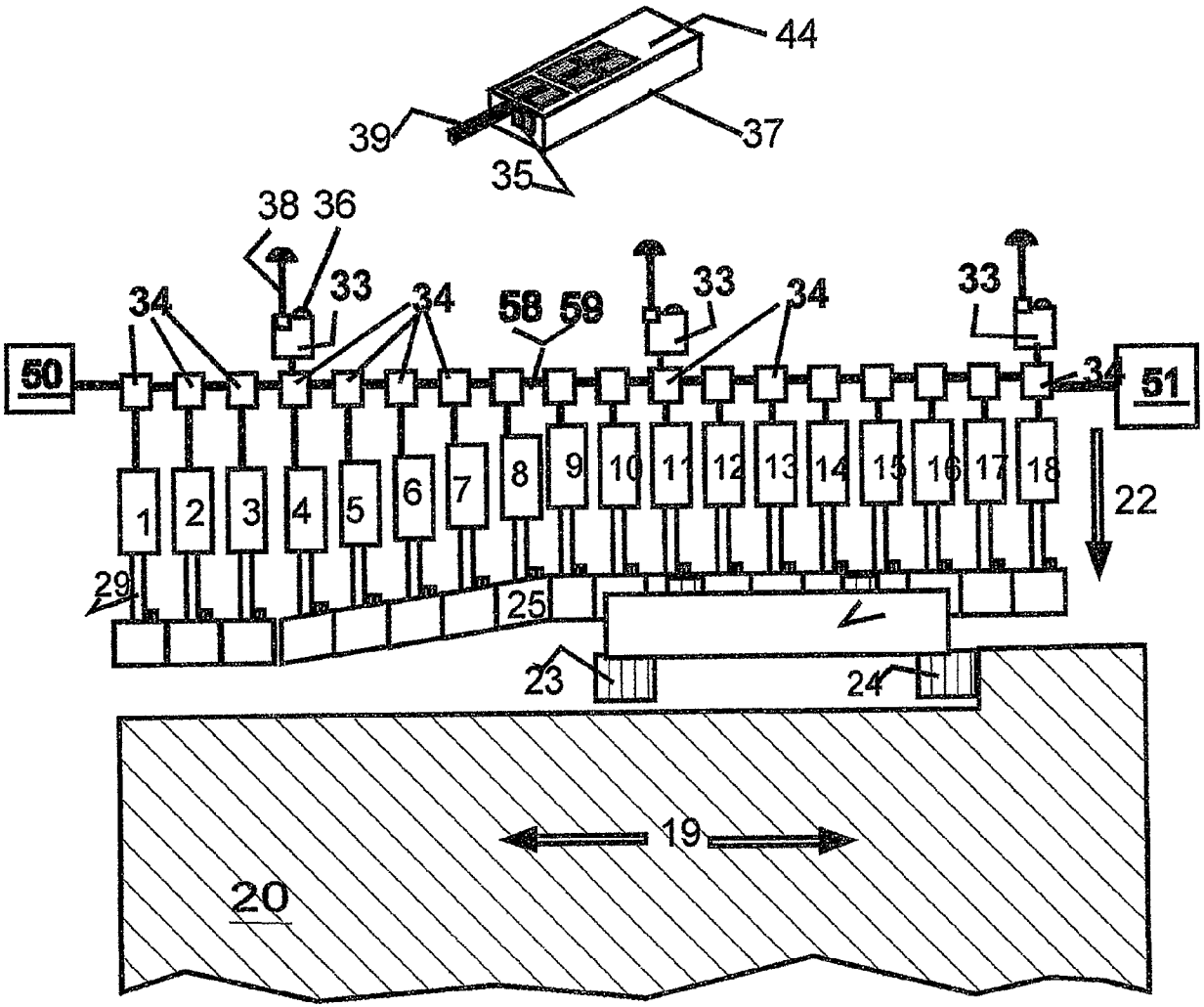
FIG. 2 is a schematic view of a coal cutting machine and a group of longwall supports.

FIG. 1 illustrates one of longwall support units 1-18. FIG. 2 illustrates a plurality of longwall support units 1-18. The support units are arranged along a coal bed 20. The coal bed 20 is mined in a working direction 22 with a cutting device 23, 24 of an extraction machine 21. In the illustrated embodiment, the extraction machine is a coal cutting machine 21.

The coal cutting machine 21 is movable in a cutting direction 19 by means of a cable not shown. It possesses two cutting rolls 23, 24 that are adjusted to different heights, and shear the coal face. The dislodged coal is loaded by the coal cutting machine, also named "cutter-loader," on a conveyor. The conveyor consists of a channel 25, in which an armored chain conveyor is moved along the coal face. The coal cutting machine 21 is adapted for moving along the coal face. The channel 25 is subdivided into individual units, which are interconnected, but are capable of performing a movement relative to one another in the working direction 22. Each of the units connects to one of the longwall support units 1-18 by means of a cylinder-piston unit (advance piston) 29, which is used as a biasing means. Each of the longwall support units serves the purpose of supporting the longwall. To this end, a further cylinder-piston unit 30 is used, which stays a base plate relative to a roof plate. At its front end facing the coal bed, the roof plate mounts a so-called coal face catcher 48. This catcher is a flap that can be lowered in front of the mined coal face. The coal face catcher must be raised ahead of the approaching coal cutting machine 21. Likewise to this end, a further cylinder-piston unit not shown is used. These operating elements of the individual longwall support are shown only by way of example. While additional operating elements are present, they need not be mentioned and described for the understanding of the invention.

As aforesaid, each of the biasing means is a hydraulic cylinder-piston unit.

These cylinder-piston units are actuated via valves 44 and pilot valves 45. The pilot valve mounts a valve control device 40, i.e., a housing that accommodates the valve control.

In FIG. 2, the coal cutting machine moves to the right. For this reason, it is necessary that the coal face catcher of the longwall support unit 17 be folded back. On the other hand, the unit of channel 25 on the longwall support unit 9, which is located—in the direction of movement 19—behind the coal cutting machine 21, is advanced in the direction toward the mined coal face. Likewise, the following longwall support units 8, 7, 6, 5, and 4 are in the process of advancing in the direction toward the longwall or the mined coal face. The coal face catcher on these longwall support units has already been lowered again. The support units 3, 2, 1 have finished their approach and remain in this position, until the coal cutting machine approaches again from the right.

As a function of the movements and the instantaneous position of the coal cutting machine, the control of these movements occurs in part automatically, in part by hand. To this end, a separate mining shield control device 34 is associated to each of the longwall support units 1-18, and longwall control devices 33 are separately associated with respective groups of longwall supports or mining shield control devices. Each of the mining shield control devices 34 is associated to one of the longwall support units 1-18 and separately connected to the pilot valves 45 and main valves 44 of all biasing means of the longwall support units 1-18 via a valve control device (microprocessor) 40.

Each of the mining shield control devices serves as a central longwall support control. However, a group of a plurality of mining shield control devices can be superposed by a longwall control device 33, or also the entirety of the mining shield control devices can be superposed by a central longwall support control system (primary central control system 50 and/or secondary central control system 51), which connects to the mining shield control devices. Such an arrangement is shown in FIG. 2.

The central longwall support control system consists of the primary central control system 50 and secondary central control system 51.

A cable 58 (bus line) interconnects all mining shield control devices 34. Each of the mining shield control devices retransmits the operating commands. The operating command triggers in a certain mining shield a certain operating function, for example, in the sense of robbing, advancing, and setting. This mining shield operating command is received and retransmitted by all mining shield control devices 34 via the bus line 58. All operating commands of one of the longwall control devices are directly transmitted to the mining shield control device that is directly connected to the longwall control device 33. From this mining shield control device, the operating commands then reach all other mining shield control devices 34 via the bus line 58. However, by a predetermined coding, only one of the longwall support units 1-18 or a group thereof is activated for carrying out the respective shield functions. The activated mining shield control device then converts the received operating command into valve control commands to the control valves or main valves that are associated to the particular mining shields.

The automatic release of the functions and operating sequences is disclosed, for example, in DE-A1 195 46 427.3.

For a central manual operation of the command input, use is made of a control device 37, which is designed and constructed for manual operation and carried along by the operator. To input the command, the operator can be outside of the longwall, or stand at least at a distance from the instant working location.

The hand-operated device connects by means of radio to radio receivers 38 of the longwall control devices 33. The hand-operated device may have the shape of a rectangular block and comprises operating keys on its one side (control side). With these keys, it is possible to input also the code of each longwall support control (one of the mining shield control devices 34.1, 34.2 . . . ) that is to be operated, and an operating command to release a desired function or a desired operational sequence (for example, robbing or advancing). For a radio transmission, for example, an antenna 39 of the hand-operated device is used.

When the operator rotates the hand-operated device about its longitudinal axis by 180°, he will see the control side of the device. This side comprises two diodes, a display, as well as additional keys. With his head lamp, the operator is able to illuminate the two diodes. Only when he covers in this process the one of the diodes, for example, with a finger, will the checking function of the hand-operated device be started. For an inspection, the operator inputs the code of the longwall support that is to be inspected. As a result, the hand-operated device connects via an infrared transmitter/receiver 35 to a tuned infrared transmitter/receiver 36 on the longwall control device 33 that is addressed by the code. By means of one of the keys, it is now possible to recall certain functions or operating conditions. To this end, the longwall control system stores a program, which permits directing a sequence of inquiries concerning functions, operating conditions, and operating functions of a certain mining shield (longwall support unit) to the mining shield control device that is addressed by codes, and performing same thereon. Subsequently, the received data are transmitted by means of the infrared transmitters/receivers 35, 36 to the hand-operated device, and shown on the display. In this manner, the operator is able to convince himself, whether a certain longwall support unit is still fully operable, or whether it requires maintenance or replacement of operating elements or control elements.

This enables a reliable, trouble-free, and robust operation of the coal cutting machine and the longwall support, which requires little operating expenditure. It has been found that even in underground mining, a reliable, trouble-free radio transmission of the required position and direction signals is possible, and that even in the case of a significant longwall length, the longwall support control system can be reliably controlled via one or few radio receivers. To this end, the control device has the characteristic of retransmitting signals that are transmitted to one or individual control devices, to the others, and of enabling, via a common computer capacity, a reliable investigation of the longwall support units that are to be addressed respectively.

As aforesaid, the mining shield control devices 34 are interconnected by means of the cable 58, which has in the designs of the art only two conductors, and serves for serially transmitting respectively a code word and the mining shield operating command. Only that mining shield control device 34 (longwall support units) is addressed, whose stored code word is identical with the transmitted code word. Thus, the cable 58 is a two-conductor cable, which extends in the form of a bus line from one mining shield control device 34 to the next, and also interconnects the primary central control system 50 and the secondary central control system 51 via the intermediate mining shield control devices 34.

The present invention uses in the place of the previous single two-conductor cable 58, parallel thereto a second two-conductor cable 59, in the present application, also named parallel bus. In the present application, the cables 58, 59 are also called bus lines.

Figure 3:
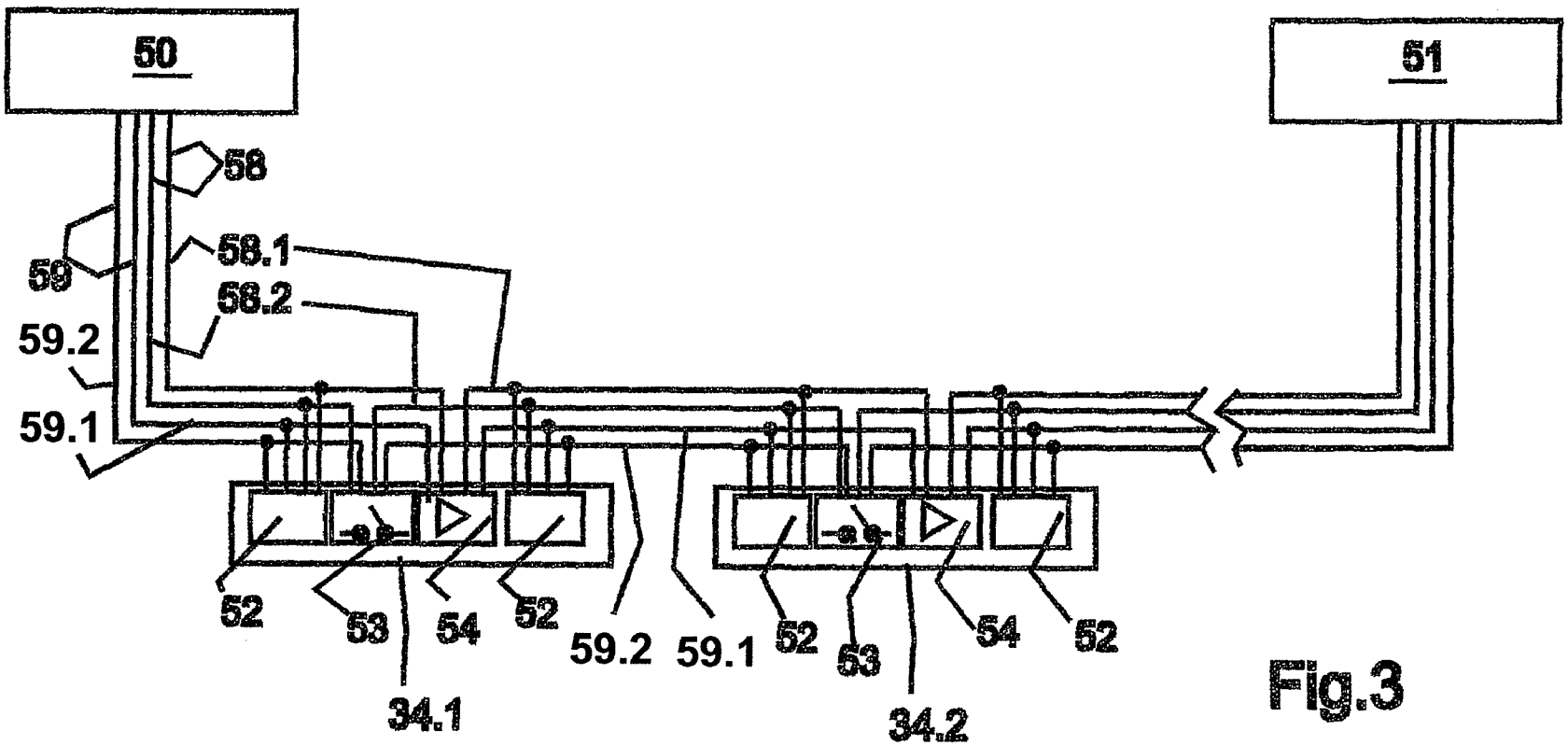
FIG. 3 illustrates a schematic arrangement of a central control system and mining shield control devices.

The wiring principle of the cables in the individual mining shield control devices 34 is shown in FIG. 3. Illustrated are two mining shield control devices 34.1 and 34.2 of a plurality of mining shield control devices. The mining shield control devices connect via the bus lines 58 and 59 to the primary central control system 50 and secondary central control system 51. The bus line 58 has two phase conductors 58.1 and 58.2; the bus line 59 has two phase conductors 59.1 and 59.2.

All four phase conductors of the two bus lines connect to input elements 52 of the mining shield control devices 34.1, 34.2 . . . . From the input elements, the incoming signals are processed in the mining shield control devices, i.e., they are first checked to the extent whether the transmitted code word corresponds to the stored code word associated to this particular mining shield control device. Provided the signals being transmitted are control signals, they are then processed and retransmitted to the corresponding operational elements of the shield, which have been previously described.

Each of the phase conductors 58.2 and 59.2 of each of the bus lines is then supplied to a switching element 53. The corresponding phase conductors leave the switching element 53 via its output and subsequently enter the corresponding switching element 53 of the adjacent mining shield control device 34.2. In the switching element 53, the two phase conductors 58.2 and 59.2 can be separated synchronously or individually.

The other phase conductors 58.1 and 59.1 of the bus lines 58 and 59 are then supplied to an amplification element 54. From the output of the amplification element, the corresponding phase conductors are each supplied to the amplification element of the adjacent mining shield control device 34.2 . . . . Each mining shield control device 34.1, 34.2 . . . has a further "right-hand" input element 52, which receives and processes the signals that come in from the right side, i.e., the secondary central control system 51, or a mining shield control device 34.3 . . . located further to the right. Adjacent mining shield control devices 34.1, 34.2 are thus again connected by two cables, which each have two phase conductors.

The switch 53 with its two switching elements is normally closed, so as to allow signals to pass through it. However, a separation of the bus lines will proceed upon occurrence of failures. This will facilitate trouble shooting on the one hand. To this end, one of the control devices (primary and secondary central control systems, hand-operated device, longwall control device, or mining shield control device) will open the switching elements of the mining shield control devices on the right or left, individually and serially. Thereafter, a control signal will be input. Since the addressed mining shield control devices immediately acknowledge the control signal, it will then be possible to determine, which of the mining shield control devices are located beyond the faulty mining shield control device. On the other hand, the separation can proceed in the case of failure for purposes of isolating a faulty mining shield control device and separate it from the bus line or lines. As a result, the remaining mining shield control devices will remain activatable, and the failure can be eliminated without shutting down the longwall.

In the amplification element 54, the incoming digital signals are refreshed. This occurs by determining in the amplification element, whether the incoming signals exceed a certain predetermined threshold value. If this is the case, signals of greater strength, preferably of the original strength, will be generated in the output, so that transmission of the signals through all mining shield control devices is ensured. This type of amplification presents itself in particular, since control signals, measuring signals, etc. are transmitted in digital form.

When one of the central control systems 50, 51, or the hand-operated device 37 (FIG. 2) inputs a control command into the system, the control command will be transmitted via the respectively free bus line 58 or 59. In this process, the control commands are transmitted in the described manner through the individual mining shield control devices 34.1, 34.2 . . . . Only that mining shield control device will be addressed, whose stored code word corresponds to the code word that is assigned to the control signal. The receipt and/or the execution of the corresponding control command can be acknowledged by a feedback signal, since one of the two bus lines 58 or 59 is available for this purpose. The feedback can occur immediately and without time delay, so that also an immediate control is possible on the input device, i.e., primary central control system 50, secondary central control system 51, or hand-operated device 37. The corresponding control signals are retransmitted to the valve control device 40 (FIG. 1), whereby the control magnet 47 of the pilot valve 45 is activated, and the respective main valve 44 of the biasing means 30 is actuated. It is now also possible to retransmit, via the bus lines, the signals of the pressure sensors, which are arranged for controlling and monitoring on each of the biasing means and/or valves.

Many modifications and other embodiments of the invention set forth herein will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

The invention claimed is:

1. A longwall support control for controlling the movements of a plurality of longwall support units in the longwall of a mine, comprising:

a central control system; and a separate mining shield control device locally and operationally associated to each longwall support unit, the mining shield control devices connecting to the central control system and serially connected to one another by means of at least one bus line, through which each of the mining shield control devices, for inputting a control command, can be called up from the central control system or an adjacent mining shield control device, and with each mining shield control device being programmed such that it is possible to deliver for execution to its associated longwall support unit control commands that are received via the one bus line, and with each mining shield control device storing a code word uniquely associated with the respectively called up mining shield control device, and wherein the mining shield control devices connect via a parallel second bus line to the central control system and to one another, and the mining shield control devices are programmed such that signals that are received via one of the bus lines, and which do not include a code word associated with the respectively called up mining shield control device, are retransmitted to the adjacent mining shield control device.

2. The longwall support control of claim 1, wherein each mining shield control device comprises an amplifier for the control command signals that do not include a code word assigned to the respectively called up mining shield control device, and which are received via at least one of the bus lines.

3. The longwall support control of claim 1, wherein each mining shield control device comprises a switching element, which permits separating a phase conductor of at least one of the bus lines.

4. A longwall support control for controlling the movements of a plurality of longwall support units in the longwall of a mine, comprising:

a central control system; and a separate mining shield control device locally and operationally associated to each longwall support unit, the mining shield control devices connecting to the central control system and serially connected to one another by means of at least one bus line, through which control commands can be fed to all of the mining shield control devices from the central control system or an adjacent mining shield control device, each mining shield control device storing a code word uniquely associated with the respective mining shield control device, wherein signals that are fed via the bus line do include a code word, and with each mining shield control device being programmed such that those signals received via the bus which include that code word associated with the respective mining shield control device are delivered for execution to that mining shield control device, wherein the mining shield control devices connect via a parallel second bus line to the central control system and to one another, and all digital signals including control commands and measuring signals can be fed by the first or the second bus line, and wherein each of the mining shield control devices is programmed such that signals that are received via one of the bus lines, are delivered to an input element for executing at least one of the following measures: delivering signals which do include the code word associated with the respectively called up mining shield control device to the respective operational element of that mining shield for execution; releasing at the same time and without substantial delay an acknowledgement signal on the respective other bus line acknowledging receipt or execution of the command signal; or feeding signals that are received via one of the bus lines, and which do not include the code word associated with the respective mining shield control device to an amplification element for amplification and transmittal to the adjacent mining shield control device.

* * * * *